United States Patent [19]

Ikeda

[11] 4,429,817

[45] Feb. 7, 1984

[54] TREATING AGENT SHOOTING APPARATUS OF LAUNDRY MACHINE

[75] Inventor: Yoshio Ikeda, Aichi, Japan

[73] Assignee: Tokyo Shibaura Denki Kabushiki Kaisha, Kawasaki, Japan

[21] Appl. No.: 250,144

[22] Filed: Apr. 2, 1981

[30] Foreign Application Priority Data

Apr. 3, 1980 [JP] Japan ..... 55-44817
Apr. 30, 1980 [JP] Japan ..... 55-57194

[51] Int. Cl.[3] ..... D06F 39/02

[52] U.S. Cl. ..... 222/652; 222/252; 222/309; 222/363; 68/17 R

[58] Field of Search ..... 222/164, 166, 652, 252, 222/363, 364; 68/17 R; 134/93, 56 D, 57 D, 57 DL, 58 D, 58 DL, 100, 101

[56] References Cited

U.S. PATENT DOCUMENTS 4,009,598 3/1977 Bernard et al. ..... 68/17 R X

FOREIGN PATENT DOCUMENTS 53-40831 10/1978 Japan .
54-24274 2/1979 Japan .
54-8769 10/1979 Japan .

*Primary Examiner*—Joseph J. Rolla
*Assistant Examiner*—Frederick R. Handren
*Attorney, Agent, or Firm*—Cushman, Darby & Cushman

[57] ABSTRACT

A treating agent dispensing apparatus of a laundry machine comprises a dispensing vessel rockable between a dispensing stand-by position wherein a treating agent is reservably received and a dispensing position wherein the reserved treating agent is discharged into a tank, a control lever movable between an original position, a treating agent feed position and vessel return and intermediate position, an interlocking mechanism moved by the control lever when the control lever is moved from the original position and to the vessel return position, whereby the dispensing vessel is rocked from the dispensing position to the dispensing stand-by position, and a treating agent feeding mechanism moved by the control lever when the control lever is moved from the vessel return position to the treating agent feed region, whereby a predetermined amount of treating agent from a storage source is fed into the dispensing vessel located in the dispensing stand-by position.

14 Claims, 16 Drawing Figures

TREATING AGENT SHOOTING APPARATUS OF LAUNDRY MACHINE

BACKGROUND AND SUMMARY OF THE INVENTION

This invention relates to a treating agent dispensing apparatus of a laundry machine such as a washer and dryer capable of automatically casting a predetermined amount of treating agent, such as a detergent or finishing agent, into a washing or rinsing tank during a desired process.

In order to dispense e.g. a finishing agent as the treating agent automatically into the washing tank during the desired process, some of prior art washing machines are so designed that a treating agent dispensing vessel to store a charge of treating agent is disposed under the control box of the washing machine so that it may rock between a dispensing stand-by position where it can receive and reserve the finishing agent and a shooting position where the finishing agent is discharged into the washing tank.

With the washing machines of this type, the part of the opening portion of the treating agent dispensing vessel is projected into an entrance and exit for the laundry or clothes, a charge of finishing agent is fed into the treating agent dispensing vessel through the projected opening portion, and the vessel is brought into the dispensing stand-by position. When the desired process is reached, the treating agent dispensing vessel is rocked to the dispensing position to discharge the finishing agent into the washing tank. After the finishing agent is dispensed, therefore, the treating agent dispensing vessel rocked to the dispensing position needs to be manually returned to the dispensing stand-by position where it can reserve another charge of treating agent for the next dispensation. Such returning operation, however, is quite a troublesome operation because it requires the operator to place his hand into the entrance and exit for the laundry and because such entrance and exit needs a bulky cover which is not very easy to handle. Moreover, it is necessary to measure the amount of finishing agent to be shot by using a measuring cup, which adds to the troubles of the finishing agent dispensing operation.

The object of this invention is to provide a treating agent dispensing apparatus of a laundry machine capable of easily returning a treating agent dispensing vessel from a dispensing position to a dispensing stand-by position, and of fixed-quantity feeding of treating agent into the treating agent dispensing vessel in the dispensing stand-by position in conjunction with the returning operation, thus simplifying in general the preparations for the automatic dispensing of treating agent.

In an aspect of this invention, there is provided a treating agent dispensing apparatus of a laundry machine having a tank, which comprises a treating agent storage source, a treating agent dispensing vessel rockable between a dispensing stand-by position where a treating agent is reservably received and a dispensing position where the reserved treating agent is discharged into the tank, a driving mechanism for rocking the treating agent dispensing vessel from the dispensing stand-by position to the dispensing position, a control member movable between an original position and a treating agent feed region via a vessel return region, an interlocking mechanism operatively connected with the control member to be moved thereby when the control member is moved from the original position and is passing through the vessel return region, whereby the treating agent dispensing vessel is rocked and returned from the dispensing position to the dispensing stand-by position, and a treating agent feeding mechanism operatively connected with the control member to be moved thereby when the control member is moved from the vessel return region and is passing through the treating agent feed region, whereby a predetermined amount of treating agent from the treating agent storage source is fed into the treating agent dispensing vessel located in the dispensing stand-by position.

In the aforementioned treating agent dispensing apparatus of a laundry machine of this invention, the treating agent dispensing vessel can be returned to the stand-by position by only transferring the control member to the treating agent feed region via the vessel return region, and the treating agent can be fed into the vessel by means of the treating agent feeding mechanism in such stand-by position. Accordingly, both the vessel returning operation and the operation for feeding the treating agent into the vessel can be performed by only a single action. Further, the amount of treating agent to be fed can be easily controlled in accordance with the displacement of the control member.

BRIEF DESCRIPTION OF THE ACCOMPANYING DRAWINGS

This invention can be more fully understood from the following detailed description when taken in conjunction with the accompanying drawings, in which:

FIGS. 1 to 14 show a treating agent dispensing apparatus of a laundry machine, in which;

FIG. 1 is a general perspective view schematically showing the laundry machine, FIG. 2 is a cross sectional view of a portion fitted with a timer, FIG. 3 is a cross sectional view of a portion fitted with a feed-water valve, FIGS. 4 and 5 are partially sectional plan view and a disassembled perspective view showing a frame section and the interior thereof, respectively, FIG. 6 is a sectional view showing a treating agent dispensing vessel and a control lever, FIG. 7 is a sectional view showing the treating agent dispensing vessel and a treating agent feeder, FIG. 8 shows the range of movement of the control lever, FIG. 9 is a sectional view showing the timer and a lock mechanism, FIG. 10 is a disassembled perspective view of a control lever mounting section, FIG. 11 is a partially sectional side view showing a treating agent storage source and the treating agent feeder, FIG. 12 is a sectional view showing a water level setting mechanism, FIG. 13 is a plan view showing a water level selector knob, and FIG. 14 shows a part of a treating agent measuring mechanism;

FIG. 15 shows a modification of the part of the treating agent measuring mechanism; and FIG. 16 is a sectional view showing a modification of the treating agent feeder.

DETAILED DESCRIPTION OF THE EXEMPLARY EMBODIMENT

Referring now to FIGS. 1 to 14, there will be described an automtic finishing agent dispensing apparatus of a full-automatic washing machine according to an embodiment of this invention.

Figure 1:
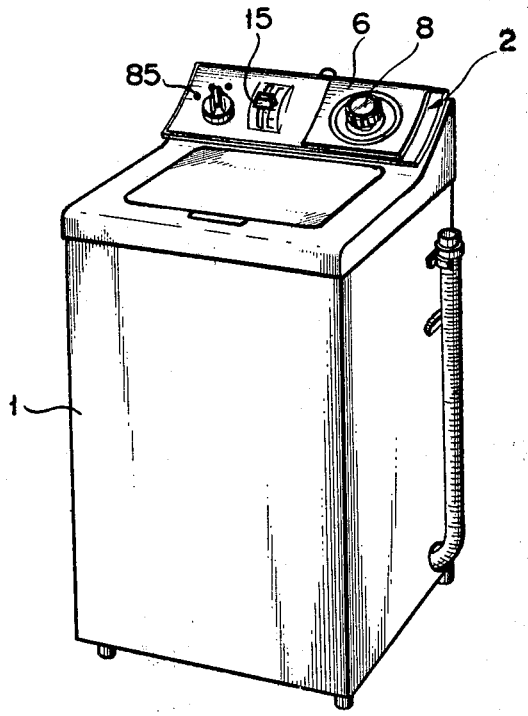
Figure 2:
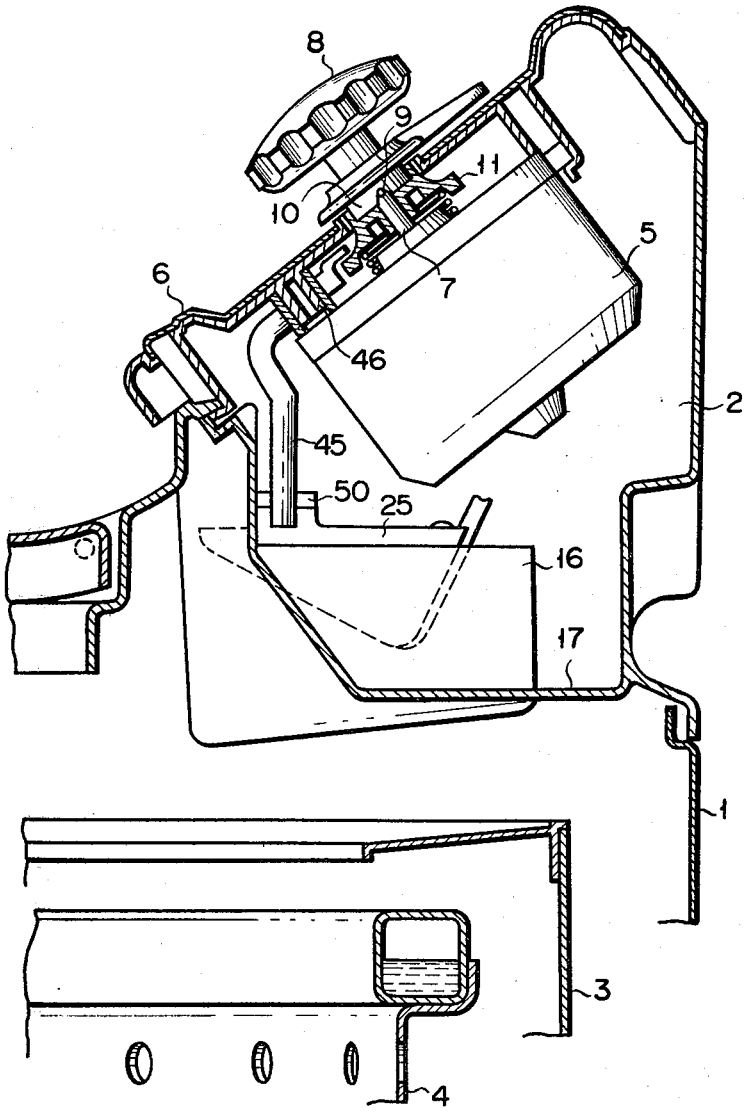
Figure 3:
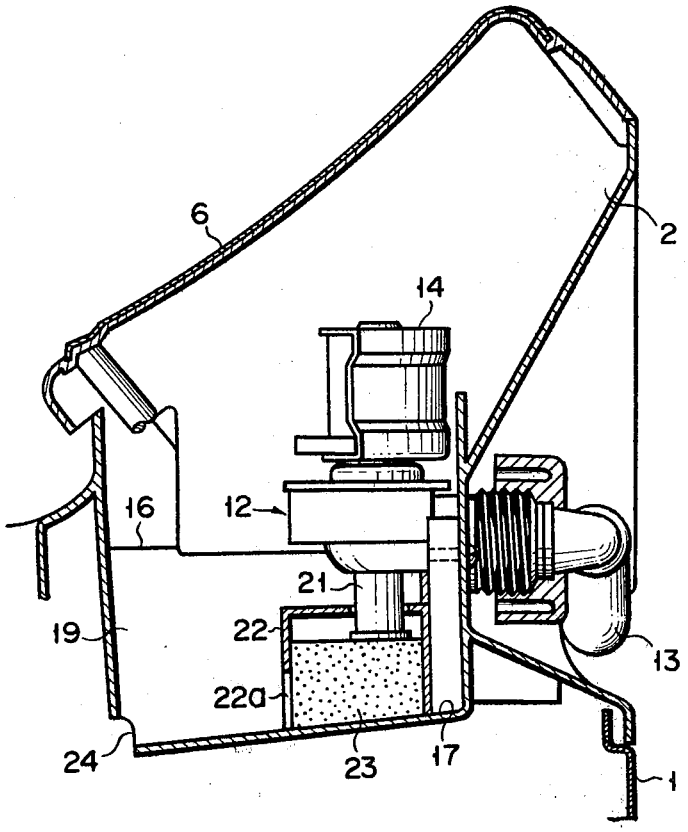
Figure 4:
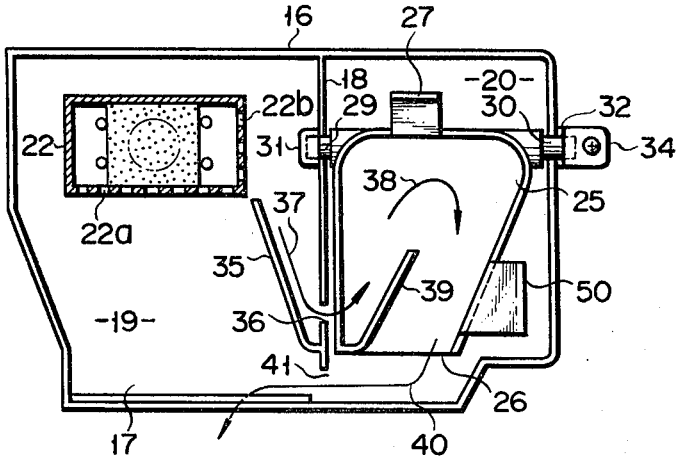
Figure 5:
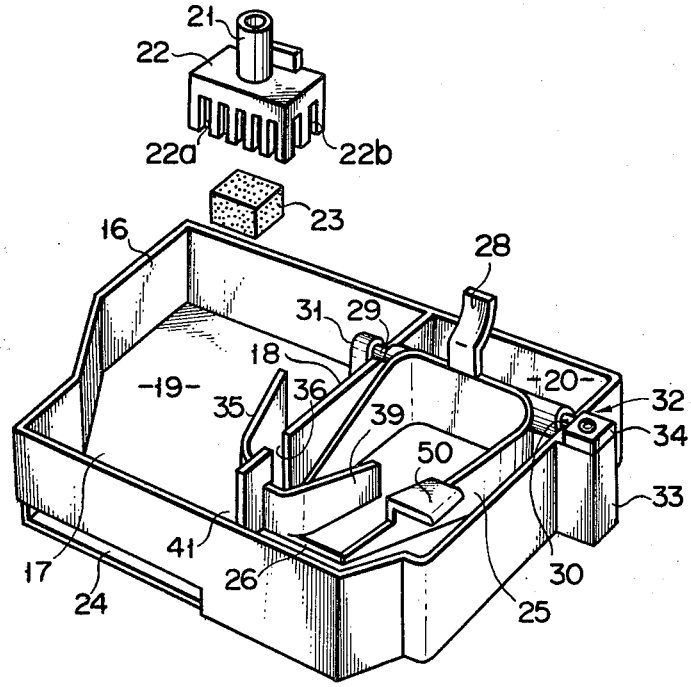
Figure 6:
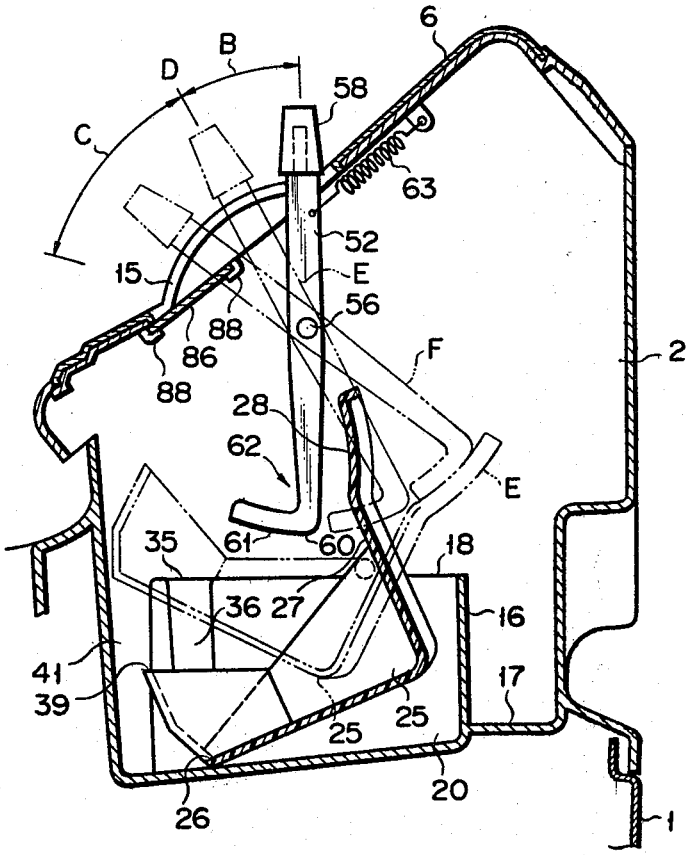
Figure 7:
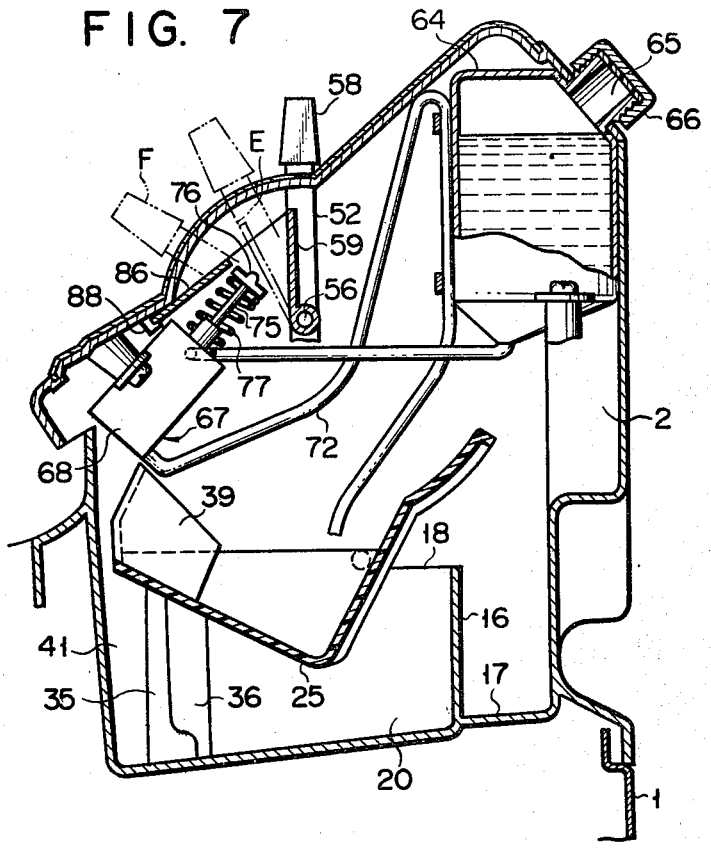

In FIG. 2, numeral 1 designates an outer casing on which a control box 2 is mounted, numeral 3 designates a water receiving tank disposed inside the outer casing 1, and numberal 4 designates a rotating tank rotatably disposed inside the water receiving tank 3 and doubling as a washing tank and drying tank. In FIG. 2, moreover, numeral 5 designates a timer attached to the back of a control panel 6 which is slantly located on the front side of the control box 2. As shown also in FIG. 9, a timer knob 8 for push-pull and rocking operations of a timing output shaft 7 of the timer 5 is coupled to the output shaft 7 by means of a pin 9, and a cam 11 is attached to a boss portion 10 of the timer knob 8 so as to rock integrally with the boss portion 10. In FIG. 3, numeral 12 designates a feed-water valve with an electromagnetic solenoid 14 disposed inside the control box 2 so as to communicate with a feed-water hose 13. In FIG. 6, numeral 15 designates a vertically extending slit which is formed in the control panel 6 so as to be adjacent to the setting position of the timer 5 on the left thereof as in FIG. 1. Numeral 16, as shown in FIGS. 4 and 5, designates a frame section in the form of an open-box which is formed integrally with a bottom portion 17 of the control box 2. The interior of the frame section 16 is halved right and left by a partition wall 18 to define a flooding chamber 19 and a receiving chamber 20. Disposed in the flooding chamber 19 is a waterway case 22 communicated with a discharge port portion 21 of the feed-water valve 12 and containing a water force attenuating member 23 therein. A multitude of waterway slits **22*a* and 22*b* are formed in the front and right-hand side walls of the waterway case 22, respectively, and a flooding port portion 24 opening into the rotating tank 4 is formed in the lower portion of the frontage of the frame section 16. Numeral 25 designates a substantially bilge-shaped treating agent dispensing vessel whose forward end functions as a discharge end 26. A receiving projection 27 integrally protrudes upward from the substantially central portion of the upper edge of the rear wall of the vessel 25, and an arcuate inner surface 28 is formed in the upper region of the projection 27. Further, shafts 29 and 30 integrally coaxially protrude on both sides of the backward portion of the treating agent dispensing vessel 25. These shafts 29 and 30 are rotatably supported by bearings 31 and 32 which are mounted on one side wall and the partition wall of the frame section 16, respectively, thereby locating the treating agent dispensing vessel 25 inside the receiving chamber 20 of the frame section 16 so that the vessel 25 can rock around the shafts 29 and 30 or the horizontal axis between a dispensing stand-by position as shown in FIG. 7 and a dispensing position indicated by full lines in FIG. 6. In particular, one bearing 32 is composed of a bearer portion 33 formed integrally with the frame section 16 and a pressing plate 34 screwed to the bearer portion 33 so that the shaft 30 may be held between the bearer portion 33 and the pressing plate 34, thereby enabling the treating agent dispensing vessel 25 to be coupled to the frame section 16. In FIGS. 4 and 5, numeral 35 designates a water guide wall protruding within the flooding chamber 19 of the frame section 16 so as to receive water discharged from the waterway slits 22*b* of the waterway case 22, whereby the received water is allowed to flow through a waterway opening 36 at the forward end portion of the partition wall 18 into the treating agent dispensing vessel 25 in its dispensing position, as indicated by an arrow 37. Another water guide wall 39 protrudes from the discharge end 26 toward the inner part of the treating agent dispensing vessel 25 so that the flow of water may be further led into the inner part of the vessel 25. Thus, the treating agent dispensing vessel 25 can be washed after treating agent is discharged therefrom. As may be understood from the later description, moreover, when the treating agent dispensing vessel 25 is rocked to the dispensing position, the treating agent therein is discharged through the discharge end 26 into the receiving chamber 20. Further, the flooding chamber 19 and the receiving chamber 20 communicate with each other at their front portions by means of a passage 41 so that the discharged treating agent may flow in the direction of an arrow 40 to be finally cast together with water into the rotating tank 4 through the flooding port portion 24**.

Figure 9:
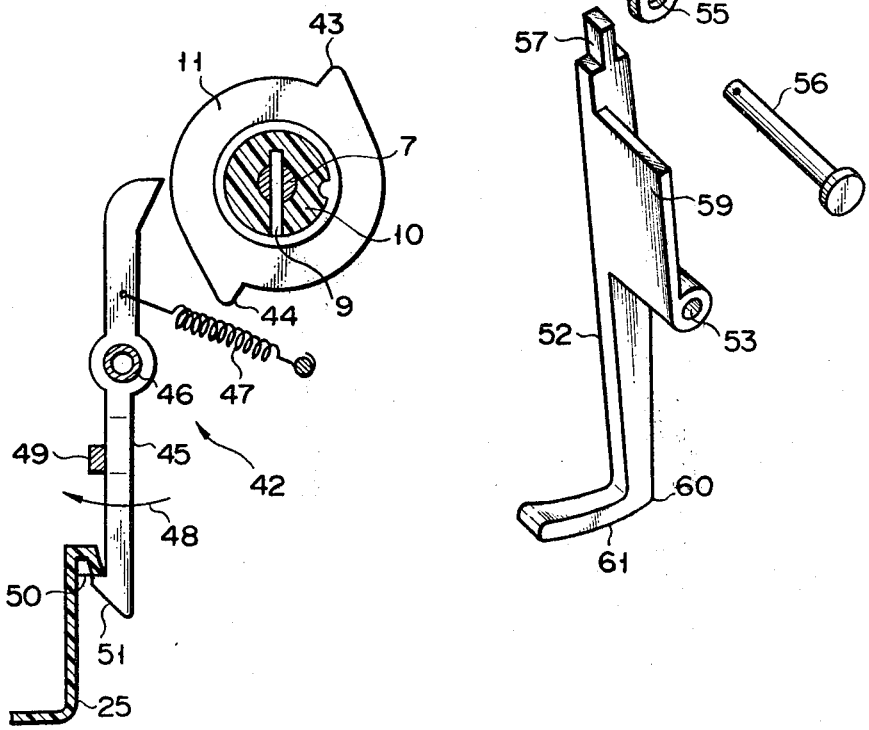

Referring now to FIG. 9, a lock mechanism 42 will be described. Formed on the outer circumference of the cam 11 are two cam projections 43 and 44 which correspond to so-called regular and economy courses, respectively. A substantially middle portion of an operating rod 45 is rockably mounted on a boss 46 protruding from the back of the control panel 6 so that the operating rod 45 may be selectively pressed and rocked by the cam projections 43 and 44. Also, the operating rod 45 is always urged by a tension spring 47 to rock in the retaining direction of an arrow 48 to a position where it abuts against a stopper 49. Formed on the lower end of the operating rod 45 is an engaging hook 51 which removably engages an engaging projection 50 formed on one side of the treating agent dispensing vessel 25. By the engagement between the engaging projection 50 and the engaging hook 51, the treating agent dispensing vessel 25 can be maintained in the substantially horizontal dispensing stand-by position.

Figure 8:
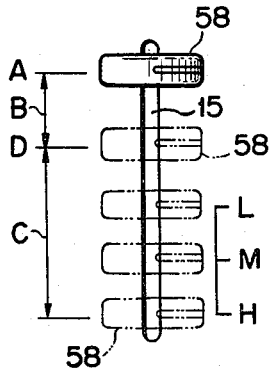
Figure 10:
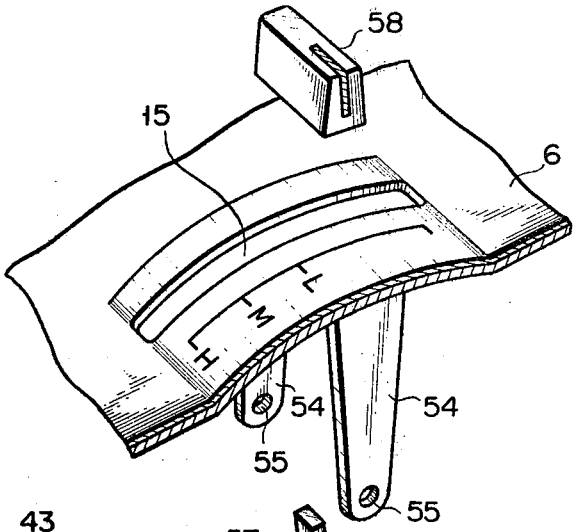
Figure 11:
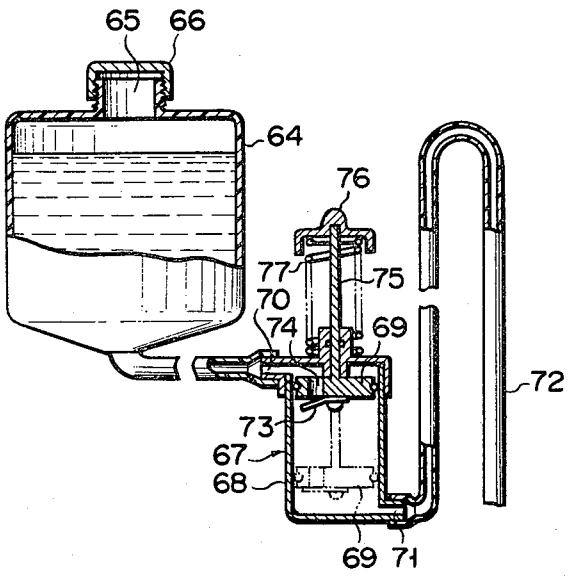

In FIG. 10, numeral 52 designates a control lever capable of rocking relatively to the control panel 6 by means of a shaft member 56 which is passed through a pivotal hole 53 in the middle of the lever 52 and through holes 55 at the tip portions of a pair of support members 54 protruding from the back of the control panel 6 with the slit 15 therebetween. The upper end 57 of the control lever 52 is projected outward through the slit 15, and a knob 58 is attached to the projected end. As shown in FIG. 8, the control lever 52 rocks within a displacement range from an original position A via a vessel return region B to the end of a treating agent feed region C. For convenience, "L" (low water level), "M" (medium water level) and "H" (high water level) are marked expressly on a portion corresponding to the treating agent feed region C on the periphery of the slit 15. On the control lever 52, moreover, there are formed a pressing portion 59 extending upward from the pivotal hole 53 and an extended strip portion 61 arcuately extending from an engaging end 60 on the bottom end of the lever 52. The control lever 52, along with the receiving projection 27 of the treating agent dispensing vessel 25, constitutes a motion mechanism 62. In FIG. 6, numeral 63 designates a tension spring stretched between the control lever 52 and the panel 6, whereby the control lever 52 is always urged to rock toward the original position A. In FIG. 7, numeral 64 designates a storage tank as a treating agent storage source. A supplement port portion 65 protruding outward from the upper portion of the storage tank 64 is supported by the upper portion of the control box 2, and a finishing agent supplied through the supplement port portion 65 is stored in the storage tank 64. Numeral 66 designates a cap for the supplement port portion 65. Numeral 67 designates a treating agent feeder which is composed of a cylinder 68 and a piston 69, and is slantly screwed to the back of the control panel 6. As shown in FIG. 11, an inlet port 70 formed at the upper portion of the cylinder 68 communicates with the bottom portion of the treating agent storage tank 64, and a discharge port 71 formed at the lower portion of the cylinder 68 is connected with one end of a tube 72, the other end of which opens downwardly into the treating agent dispensing vessel 25 with a part of the tube 72 located higher than the maximum liquid level of the treating agent storage tank 64. A liquid passage hole 74 having a check valve 73 is formed through the piston 69, and a pressure receiving member 76 is attached to the tip of a piston rod 75 penetrating the end wall of the cylinder 68. Further, the piston 69 is always urged to move toward the inlet port 70 by a compression coil spring 77 interposed between the pressure receiving member 76 and the end face of the cylinder 67. In this state, the pressure receiving member 76 faces the pressing portion 59 of the control lever 52.

Figure 12:
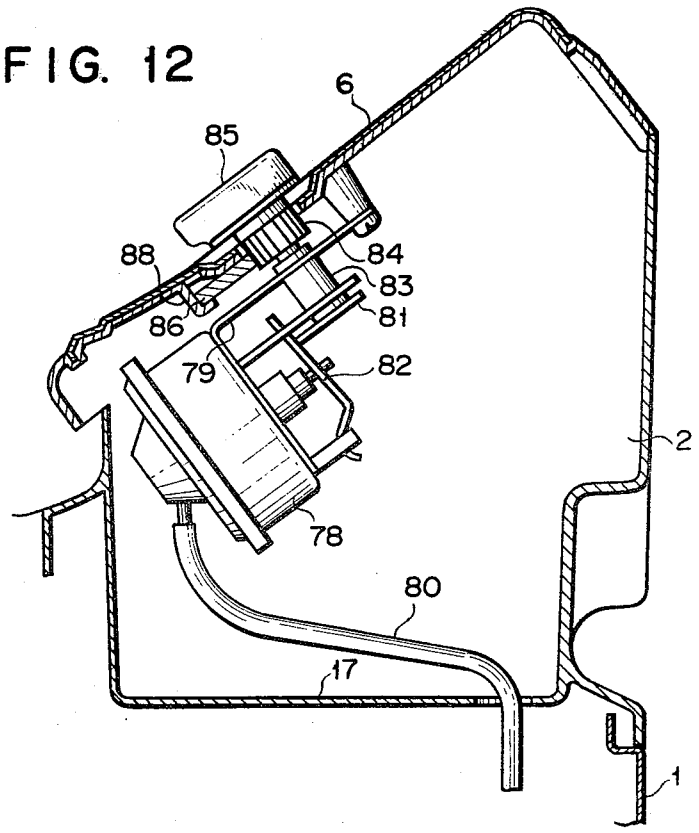
Figure 14:
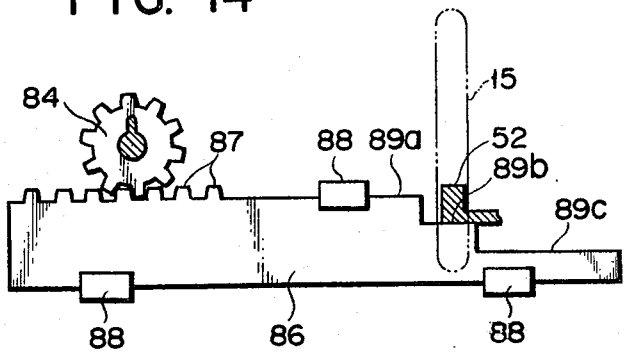
Figure 13:
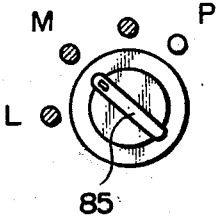

In FIG. 12, numeral 78 designates a water level switch attached to the control panel 6 by means of a fixture 79 so as to be adjacent to the left-hand side of the control lever 52 as in FIG. 1. As is generally known, the water level switch 78 is a pressure-responsive switch which receives air pressure corresponding to the feed water level inside the rotating tank 4 or the washing tank through a tube 80. The feed water level can be set between three stages—low, medium and high water levels—by switching the received pressure by means of a water level selector lever 82 interlocking with a cam 81. Numeral 83 designates a water level setting shaft fitted with the cam 81. A gear 84 is coaxially coupled to the middle portion of the water level setting shaft 83, and a water level selector knob 85 is attached to the tip end of the shaft 83 which is projected through the control panel 6. As shown in FIG. 13, "L" (low), "M" (medium), "H" (high) and "P" (pour water again) are marked on the top of the control panel 6 on which the water level selector knob 85 is located. In FIG. 14, numeral 86 designates a transversely elongated, plate-like movable stop member with a rack 87 formed on the left portion of its upper edge. The movable stop member 86 is disposed at the back of the control panel 6 so that it may slide in the transverse direction with its rack 87 kept engaged with the gear 84, and is slidably held and guided by guiding projections 88 three-pointedly arranged on the control panel 6. Two steps are formed on the right-hand side of the upper edge of the movable stopper member 86 free from the rack 87 so as to provide a stop surface **89*a* for low water level, a stop surface 89*b* for medium water level, and a stop surface 89*c* for high water level on which a predetermined portion of the control lever 52 between the pivotal hole 53 and the control end side abuts selectively. Thus, there is constructed a treating agent measuring mechanism 90. In the treating agent measuring mechanism 90, therefore, when the water level selector knob 85 is turned, the gear 84 rotates to move the movable stopper member 86 with its rack 87 engaging the gear 84. Then, the stopper surface 89*a*, 89*b*, or 89*c* for low, medium or high water level selectively corresponds to, in particular, the treating agent feed region C of the slit 15 for the shift of the control lever 52 when the water level selector knob 85 is set to "L," "M" or "H." When rocked from the original position A of FIG. 7 toward the bottom end, therefore, the control lever 52 abuts against that one of the stop surfaces 89*a*, 89*b* and 89*c* which corresponds to the slit 15 to be prevented from further movement. Thus, the stroke or displacement of the control lever 52 from the original position A is regulated in accordance with the angular displacement of the water level setting shaft 83 of the water level switch 78** and hence with the set water level provided thereby.

Now there will be described the operation of the aforementioned construction. Here let it be supposed that the treating agent dispensing vessel 25 is left as it is rocked counterclockwise or to the dispensing position by a preceding washing operation, as indicated by solid lines in FIG. 6. Further, suppose that the water level selector knob 85 is set to the medium water level or "M" of FIG. 13 so that the stop surface **89*b* for medium water level of the movable stop member 86 corresponds to the slit 15. In this state, a treating agent such as a finishing agent may be automatically dispense for the current washing operation by rocking the control lever 52 at a stroke from the original position A until it abuts against the stop surface 86*b* of the movable stop member 86, as shown in FIG. 14. This operation will now be described further in detail. When the control lever 52 rocks counterclockwise from the original position A to the end D of the vessel return region B, the engaging end 60 abuts against the receiving projection 27 of the treating agent dispensing vessel 25, as indicated by chain lines E in FIG. 6, to rock the vessel 25 in the clockwise direction. Thus, the engagement between the engaging projection 50 of the treating agent dispensing vessel 25 and the engaging hook 51 of the operating rod 45 is recovered, and the vessel 25 is finally maintained in the dispensing stand-by position. While the control lever 52 is rocked counterclockwise from this position to the position "M" in the treating agent feed region as indicated by chain lines F in FIG. 6, that is, until it engages the stop surface 89*b* for medium water level, the pressing portion 59 presses and moves the piston 69 toward the discharge port 71 of the cylinder 68 by means of the pressing member 76 of the piston rod 75. Accordingly, a fixed amount of finishing agent corresponding to the shifting distance of the piston 69, that is, the displacement of the control lever 52 from the position D to the position "M" of FIG. 8, is fed from the cylinder 68 into the treating agent shooting vessel 25 through the discharge port 71 and the tube 72. In this case, the aforesaid rocking of the control lever 52 within the treating agent feed region C causes the extended strip portion 61 integral with the control lever 52 only to slide on the arcuate surface 28 of the receiving projection 27 of the treating agent shooting vessel 25, so that the vessel 25 can be prevented from being rocked further in the clockwise direction. As described above, the return of the treating agent dispensing vessel 25 and the supply of the automatically measured amount of treating agent thereto can be achieved by rocking the control lever 52 at a stroke from the original position A until it abuts against the medium level stopper surface 89*b* in the aforesaid manner. When one releases the control lever 52, however, the lever 52 is automatically returned to the original position A by the tension spring 63 to have its engaging end 60 disengaged from the receiving projection 27, so that the treating agent dispensing vessel 25 ceases to be prevented from rocking counterclockwise by the control lever 52. A washing operation may be started in this state. When a predetermined process, such as the final rinsing process, is entered, the water-feed valve 12 is naturally actuated, and the operating rod 45 is pressed and rocked in the opposite direction to the arrow 48 by the cam projection 44 of the cam 11, thereby releasing the hold of the treating agent dispensing vessel 25 sustained by the engagement between the engaging hook 51 and the engaging projection 50. As a result, the vessel 25 rocks by gravity to the dispensing position as indicated by solid lines in FIG. 6 to discharge the finishing agent therein. The discharged finishing agent is finally discharged through the flooding port portion 24 into the rotating tank 4**, and thus what is called the automatic dispensing of the finishing agent is completed.

When the water level selector knob 85 is set to "L" or "H" of FIG. 13, on the other hand, the shift stroke of the control lever 52 is limited to the range between the positions "L" and "H" of FIG. 7, and an amount of finishing agent corresponding to the low or high water level is allowed to be shot.

Figure 15:
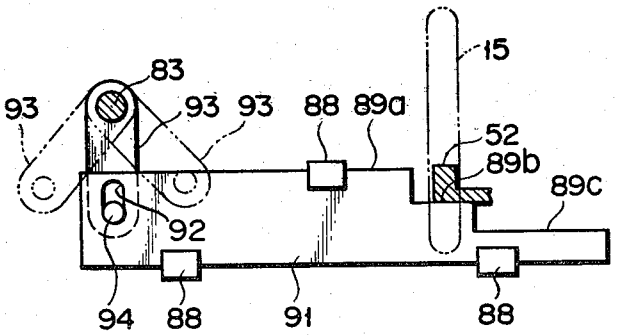

Referring now to FIG. 15, there will be described a second embodiment of the invention. In FIGS. 14 and 15, like reference numerals are used to designate the same portions as those of the first embodiment. In this second embodiment, a movable stop member 91 is provided with a slot 92 in place of the rack, and the gear 84 of FIG. 14 is replaced by a lever 93 one end of which is fixed on the water level setting shaft 83, and the other end of which has its pin 94 rockably fitted in the slot 92 so that the movable stop member 91 may be slidden from side to side by turning the water level selector knob 85.

Further, this invention is not limited to the aforementioned embodiments. For example, the gear 84 may be formed integrally with the water level selector knob 85, and the finishing agent may be cast directly from the treating agent feeder 67 into the washing tank. Furthermore, the fixed-quantity supply of treating agent may be achieved by repeatedly rocking the control lever 52 between the original position A and the selected stop surface 89*a*, 89*b* or 89*c* with a predetermined number of times. It is to be understood that the treating agent is not limited to the finishing agent, and may be a detergent or the like, whether liquid or powdered.

Although in the above embodiments the treating agent dispensing vessel is transferred from the dispensing stand-by position to the dispensing position achieved by the dead weight of the vessel itself and the location of the rocking axis of the vessel, it can alternatively be performed compulsorily by any suitable means, such as a spring.

Although the amount of finishing agent to be fed is controlled in accordance with the displacement of the control lever in the apparatus of the foregoing embodiments, such control may be achieved on the basis of the rocking frequency of the control lever.

Figure 16:
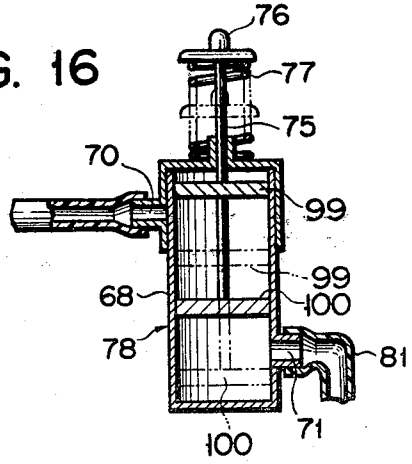

In such case, it is necessary to use a treating agent feeder of a construction as shown in FIG. 16. In this treating agent feeder 78, two piston heads 99 and 100, facing each other at a given space inside a cylinder 68, are fixed on a common piston rod so as to slide simultaneously inside the cylinder 68. While the piston heads 99 and 100 are located in their respective positions represented by solid lines in FIG. 16 by the urging force of a spring 77, a finishing agent is fed into the space between the piston heads through an inlet port 70. When the piston heads 99 and 100 are lowered against the urging force of the spring 77 as indicated by imaginary lines, however, the finishing agent stored between the two piston heads is fed into the treating agent dispensing vessel through a discharge port portion 71 and a tube 81. Then, the piston heads are restored to their original positions. By such one stroke of the piston heads 99 and 100, a fixed amount of finishing agent defined by the space between these piston heads is supplied to the feeder, and the amount of supply can be increased by increasing the stroke frequency of the piston heads 99 and 100. In this example, the amount of finishing agent supplied can be controlled without locating the middle portion of the tube 81 at an elevated spot.

What is claimed is:

1. A treating agent dispensing apparatus of a laundry machine having a tank comprising:

storage means for storing an amount of a treating agent;

a treating agent dispensing vessel rockable between a dispensing stand-by position wherein a treating agent is reservably received and a dispensing position wherein the reserved treating agent is discharged into the tank;

driving means for rocking said treating agent dispensing vessel from said dispensing stand-by position to said dispensing position;

a control member movable between an original position, a treating agent feed position, and a dispensing vessel return position intermediate said original and said feed positions, said control member including a control lever rockable around a horizontal axis, said conrol lever rocking to engage said treating agent dispensing vessel as said control member is moved to said treating agent feed position, thereby responsively rocking said dispensing vessel to said dispensing stand-by position;

interlocking means operatively connected with said control member to be moved thereby when said control member is moved from said original position to said return position for rocking said treating agent dispensing vessel and returning said dispensing vessel from said dispensing position to said dispensing stand-by position; and treating agent feeding means operatively connected with said control member to be moved thereby when said control member is moved from said vessel return position to said treating agent feed position for feeding a predetermined amount of treating agent from said treating agent storage means into said treating agent dispensing vessel while said dispensing vessel is in said dispensing stand-by position.

2. A treating agent dispensing apparatus according to claim 1, further comprising a control box having a control panel on one side thereof, said control member being located outside said control panel.

3. A treating agent dispensing apparatus according to claim 2, wherein said control box includes at the lower portion thereof a frame section with a closed bottom in which said treating agent dispensing vessel is rockably disposed, said interlocking mechanism being disposed inside said control box.

4. A treating agent dispensing apparatus according to claim 3, wherein said treating agent storage means and said treating agent dispensing vessel are disposed inside said control box.

5. A treating agent dispensing apparatus according to claim 4, wherein said driving means includes a timer operating at a set time, an operating rod engaging said teating agent dispensing vessel to hold said vessel in said dispensing stand-by position and for being driven by the action of said timer so as to be released from engagement with said vessel, and means permitting said vessel to be moved into said dispensing position when said operating rod and said treating agent dispensing vessel are in a disengaged relationship.

6. A treating agent dispensing apparatus according to claim 5, wherein said force means is composed of the dead weight of said treating agent dispensing vessel and shafts rotatably bearing said vessel.

7. A treating agent dispensing apparatus according to claim 1, wherein said treating agent dispensing vessel defines a curved surface to engage one end of said control lever, said one end of said control lever moving along said curved surface so as to not apply any rocking force to said treating agent dispensing vessel while said control member is moving to said treating agent feed position.

8. A treating agent dispensing apparatus according to claim 1, wherein said control lever includes means defining a pressing portion for engaging and actuating said treating agent feeding means when said control member is moved to said treting agent feed position, thereby causing the predetermined amount of treating agent to be discharged into said treating agent dispensing vessel.

9. A treating agent dispensing apparatus according to claim 8, wherein said treating agent feeding means includes a cylinder, a piston movably disposed inside said cylinder and having one end projecting therefrom for engaging the pressing portion of said control lever, a conduit connecting said treating agent storage means and said cylinder to direct the treating agent from said storage means into said cylinder, and a feed tube connected to said cylinder and directing the treating agent in said cylinder into said dispensing vessel in response to the movement of said piston.

10. A treating agent dispensing apparatus according to claim 9, wherein said conduit and said feed tube are connected respectively to the upper and lower portions of said cylinder, and said piston includes a one-way valve means to deliver an amount of treating agent to said feed tube corresponding to the stroke of said piston based on the displacement of said control member to said treating agent feed position.

11. A treating agent dispensing apparatus according to claim 10, further comprising means for determining the displacement of said control member at said treating agent feed position in accordance with the water level of said laundry machine.

12. A treating agent dispensing apparatus for a laundry machine of the type having a tank, said apparatus comprising:

storage means for storing a quantity of treating agent therein;

a treating agent dispensing vessel including means permitting said vessel to be pivotal about a first axis between a dispensing stand-by position wherein a predetermined amount of treating agent is reserveably contained in said vessel and a dispensing position wherein said treating agent contained in said vessel is discharged into said tank;

control means pivotally moveable about a second axis between a first position, an intermediate position and an end position, said control means including lever means engaging a portion of said vessel to responsively pivot said vessel to said dispensing stand-by position when said lever means is pivotally moved from said first position to said intermediate position;

treating agent feeding means for providing operative communication between said storage means and said veseel, said feeding means being operable in response to pivotal movement of said lever means between said intermediate position and said end position to discharge said predetermined amount of treating agent from said storage means into said vessel; and retaining and releasing means operatively connected to said vessel for retaining said vessel in said dispensing stand-by position and for releasing said vessel to permit pivotal movement thereof to said dispensing position at a preselected time during the operation of said laundry machine to discharge said predetermined amount of said treating agent into said tank at said predetermined time.

13. An apparatus as in claim 12 further comprising biasing means connected to said lever means for biasing said lever means into said first position.

14. An apparatus as in claim 12 wherein said retaining and releasing means includes:

rotatable cam means defining cam surfaces corresponding to said predetermined time; and a pivotal latch member having at one end means defining latch surfaces and at the other end thereof means defining cam following surfaces in operative association with said cam surfaces, said latching surfaces of said latch member being in latching engagement with said vessel when said vessel is in said dispensing stand-by position to retain said vessel in said dispensing stand-by position, wherein said cam means pivotally displaces said latch member at said predetermined time by virtue of said operative association of said cam following surfaces and said cam surfaces to disengage said latching surfaces and said vessel to permit said vessel to be pivotally moved to said dispensing postion.

* * * * *